US007662208B2

(12) United States Patent
Kikuchi et al.

(10) Patent No.: US 7,662,208 B2
(45) Date of Patent: Feb. 16, 2010

(54) ELECTRICAL CONTACTS FOR VACUUM CIRCUIT BREAKERS AND METHODS OF MANUFACTURING THE SAME

(75) Inventors: Shigeru Kikuchi, Hitachi (JP); Ayumu Morita, Hitachi (JP); Masato Kobayashi, Hitachi (JP); Satoru Kajiwara, Hitachi (JP); Noboru Baba, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 232 days.

(21) Appl. No.: 11/480,980

(22) Filed: Jul. 6, 2006

(65) Prior Publication Data

US 2007/0007249 A1 Jan. 11, 2007

(30) Foreign Application Priority Data

Jul. 7, 2005 (JP) ..... 2005-198210
Aug. 23, 2005 (JP) ..... 2005-240546

(51) Int. Cl.
*C22C 5/06* (2006.01)
*C22C 9/00* (2006.01)
*H01H 33/66* (2006.01)

(52) U.S. Cl. ..... 75/247; 75/236; 218/123; 218/124; 218/125; 218/128; 218/132

(58) Field of Classification Search ..... 75/236, 75/247; 218/123–125, 128, 132
See application file for complete search history.

(56) References Cited

U.S. PATENT DOCUMENTS

| | | | | | |
|---|---|---|---|---|---|
| 2,975,256 | A * | 3/1961 | Cobine et al. | ..... | 218/130 |
| 3,225,169 | A * | 12/1965 | Kosco | ..... | 200/264 |
| 3,683,138 | A * | 8/1972 | Nabae et al. | ..... | 218/130 |
| 4,147,909 | A * | 4/1979 | Hassler et al. | ..... | 200/265 |
| 4,686,338 | A * | 8/1987 | Kashiwagi et al. | ..... | 200/264 |
| 5,828,941 | A * | 10/1998 | Whitlow et al. | ..... | 419/17 |
| 2002/0117476 | A1 * | 8/2002 | Kikuchi et al. | ..... | 218/123 |

FOREIGN PATENT DOCUMENTS

| | | | |
|---|---|---|---|
| DE | 19535814 | A1 | 4/1996 |
| EP | 0385380 | A2 | 9/1990 |
| EP | 0488083 | A2 | 6/1992 |
| EP | 09171746 | | 6/1997 |
| JP | 07-029461 | | 1/1995 |
| JP | 09-171746 | | 6/1997 |
| JP | 2005-135778 | | 5/2005 |

* cited by examiner

*Primary Examiner*—Roy King
*Assistant Examiner*—Ngoclan T Mai
(74) *Attorney, Agent, or Firm*—Mattingly & Malur, PC

(57) ABSTRACT

An electrical contact used herein comprises chromium; one of copper and silver; and a carbide, in which the electrical contact comprises a matrix and chromium, the matrix phase mainly comprising one of copper and silver, and the chromium being surrounded by the carbide and dispersed in the matrix. The electrical contact contains 1 to 30 percent by weight of a carbide, with the balance being copper. Another electrical contact contains chromium, copper, and a carbide and has a weight ratio of chromium to the carbide within the range of 1:1.5 to 1:50.

17 Claims, 5 Drawing Sheets

ELECTRICAL CONTACTS FOR VACUUM CIRCUIT BREAKERS AND METHODS OF MANUFACTURING THE SAME

CLAIM OF PRIORITY

The present application claims priority from Japanese applications Serial No. 2005-198210, filed on Jul. 7, 2005 and Serial No. 2005-240546, filed on Aug. 23, 2005, the contents of which are hereby incorporated by reference into this application.

FIELD OF THE INVENTION

The present invention relates to a novel electrical contact for a vacuum interrupter for use typically in vacuum circuit breakers and vacuum switchgears, and a method of manufacturing the same.

BACKGROUND OF THE INVENTION

Vacuum interrupters disposed typically in vacuum circuit breakers and vacuum switchgears each have a pair of electrical contacts capable of being turned on and off. Receiving and distributing equipment such as vacuum circuit breakers must be downsized. To reduce such vacuum interrupters in diameter and size, the interruption performance of electrical contacts of the vacuum interrupters must be improved so as to interrupt a heavy current at electrical contacts with a small area. Chromium-copper (Cr—Cu) electrical contacts are predominantly used as electrical contacts having excellent interruption performance (Patent Document 1).

If current of the vacuum interrupter used in an inductive circuit is interrupted, abnormal surge voltage is induced, which may lead to insulation breakage of electrical equipment. The chopping current must be reduced so as to suppress the abnormal surge voltage. Accordingly, another one of requirements for electrical contacts is a small chopping current. As electrical contacts having small chopping current and low surge voltage, Co—Ag—Se alloy electrical contacts have been known (Patent Document 2 and Patent Document 3).

[Patent Document 1] Japanese Unexamined Patent Application Publication (JP-A) No. 2005-135778

[Patent Document 2] Japanese Unexamined Patent Application Publication (JP-A) No. Hei 07-029461

[Patent Document 3] Japanese Unexamined Patent Application Publication (JP-A) No. Hei 09-171746

The vacuum circuit breakers typically using Cr—Cu alloy electrical contacts are excellent in interruption performance and can interrupt a large current, but cause a surge voltage upon interruption of large current. Accordingly, they must use a surge absorber for absorbing the abnormal surge voltage, and this leads to increase in size and cost of electrical equipment.

The vacuum circuit breakers typically using Co—Ag—Se alloy electrical contacts show a low surge voltage but are unsuitable for large-current interruption.

The interruption performance and the low-surge property are considered to be theoretically incompatible with each other, because the current is interrupted at a higher value than zero to yield a larger chopping current with an increasing interruption performance. Accordingly, electrical contacts having high interruption performance and those showing a satisfactorily low surge voltage are used case-by-case to suit the type and use of vacuum circuit breakers.

In addition, the vacuum circuit breakers must maintain required properties even after carrying out interruption many times, but electrical contacts combining excellent large-current interruption performance and low-surge performance may have reduced low-surge performance after carrying out interruption many times.

SUMMARY OF THE INVENTION

An object of the present invention is to provide an electrical contact having excellent interruption performance and showing a low surge voltage concurrently, showing less deterioration in performances even after multi-time interruption, that can yield, for example, a vacuum circuit breaker, which is reduced in size and cost, and a method for manufacturing the electrical contact.

The present invention provides an electrical contact made of an alloy comprising chromium; one of copper and silver; and a carbide, wherein the electrical contact structurally has a matrix phase and a chromium phase, the matrix phase mainly comprising the one of copper and silver, and the chromium phase being surrounded by the carbide and dispersed in the matrix phase.

The present invention provides an electrical contact comprising 1 to 30 percent by weight of a carbide, with the balance being copper.

The present invention provides, in another aspect, an electrical contact comprising chromium, copper, and a carbide, wherein the weight ratio of chromium to the carbide is within the range of 1:1.5 to 1:50. This electrical contact preferably comprises 1 to 30 percent by weight of the carbide.

In a further aspect, the present invention provides an electrical contact comprising chromium, copper, and a carbide, wherein the electrical contact has a chromium content of 0.02 to 20 percent by weight and a carbide content of 1 to 30 percent by weight, with the balance being copper, and wherein the carbide content is higher than the chromium content.

The configuration provides a vacuum circuit breaker that has a reduced size and can interrupt a large current. It can also provides a vacuum circuit breaker that has excellent interruption performance and shows a low surge voltage concurrently.

The present invention can provide electrical contacts that combine excellent interruption performance and low-surge performance and show less deterioration in performances even after multi-time interruption.

DETAILED DESCRIPTION OF THE PREFERRED EMBODIMENT

Figure 1:
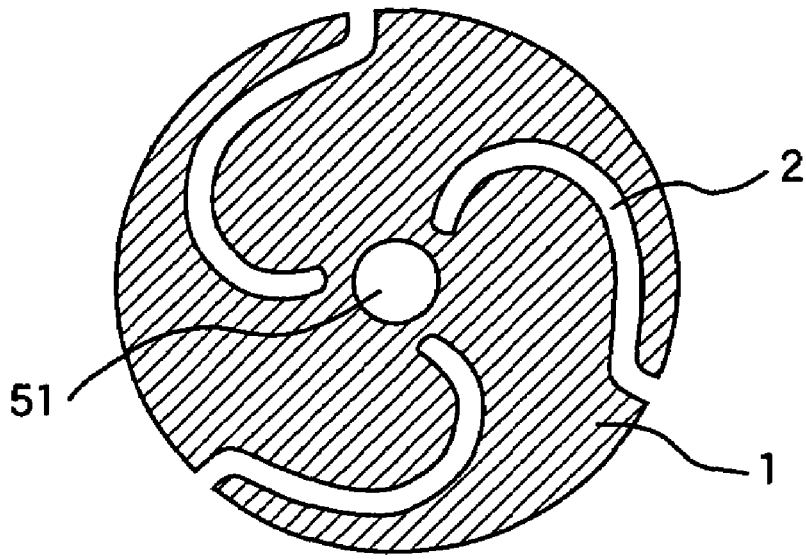
FIG. 1 is a diagram showing the structure of an electrode according to the first and second embodiments of the present invention.
Figure 1:
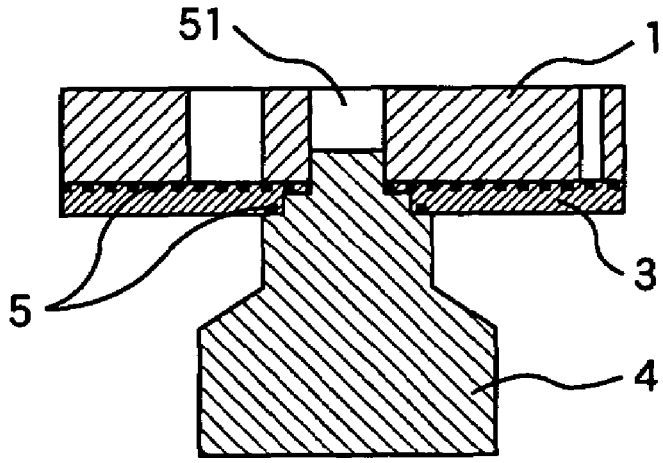

An electrical contact according to the present invention is made of an alloy comprises chromium, one of copper and silver, and a carbide and structurally has a matrix mainly comprising one of copper and silver; and a chromium phase surrounded by the carbide and dispersed in the matrix. The phrase "surrounded by the carbide" means and includes a state where the carbide is cohered in the vicinity of chromium particles or particles mainly comprising chromium, without the need for entire chromium particles being covered with the carbide. In other words, it means a state where the carbide is cohered or concentrated at the boundary between the copper or silver phase and the chromium phase.

Sufficient interruption performance is obtained by comprising chromium and one of copper and silver. In addition, the sublimation phenomenon of carbide upon current interruption reduces the chopping current and accelerates the arc drive, and the resulting vacuum circuit breaker can exhibit excellent interruption performance. The carbide exists mainly around chromium, and this ensures the current-carrying performance of the matrix mainly comprising one of copper and silver and effectively contributes to exhibit a lower surge voltage.

The electrical contact described herein according to the present invention comprises copper and a carbide and contains 1 to 30 percent by weight of the carbide with the balance being copper.

The electrical contact of this type can reduce the chopping current, accelerates the drive of arc, and can exhibit excellent interruption performance, by the action of sublimation phenomenon of the carbide upon current interruption. The chopping current is a residual current when an alternating current is interrupted. By reducing the chopping current to, for example, 3 A or less, the surge voltage can be reduced and the insulation breakage can be suppressed.

The carbide returns to a solid state during cooling process after the current interruption, because it undergoes phase change between a solid phase and a vapor phase. Thus, the electrical contact can maintain its activity to reduce the chopping current even after repeating interruption many times, for example, forty times or more, preferably fifty to hundred times.

The electrical contact can interrupt a large current of, for example, 20 KA or more and thereby combines excellent interruption performance and low-surge performance, because the carbide decomposes into gaseous components thereof to thereby reduce the surge voltage to approximately zero.

An other electrical contact described herein comprises chromium, copper, and a carbide, in which the weight ratio of chromium to the carbide of within the range of 1:1.5 to 1:50, and the carbide content is 1 to 30 percent by weight.

Yet another electrical contact described herein is made of an alloy comprising chromium, copper, and a carbide and has a chromium content of 0.02 to 20 percent by weight and a carbide content of 1 to 30 percent by weight, with the balance being copper, in which the carbide content is higher than the chromium content.

Possible alternative materials for chromium and copper are cobalt and silver, respectively.

The electrical contact according to the above-mentioned embodiment can have improved voltage endurance performance. However, the carbide content decreases after repetition of interruption, because the carbide component decomposed as a result of sublimation combines with chromium to form a compound. Accordingly, the weight ratio of chromium to the carbide is preferably within the range of 1:1.5 to 1:50. By satisfying this, the activity of reducing the chopping current can be maintained.

The content of the carbide is preferably 1 to 30 percent by weight. If the carbide content is less than this range, the chopping current is not effectively reduced. If it exceeds this range, the material for the electrical contact has a decreased density so as to fail to yield desired interruption performance.

The carbide preferably has a sublimation point or decomposition point of 1800° C. or higher. More specifically, the carbide is preferably one selected from Sic, TiC, WC, $Cr_3C_2$, $Be_2C$, $B_4C$, ZrC, HfC, NbC, TaC, ThC, and VC. The carbide may comprise two or more of these carbides.

By satisfying this, the carbide sublimates by the action of arc generated upon current interruption and acts to reduce the chopping current.

The copper may coexist with 0.2 to 1 percent by weight of lead. This improves anti-welding performance of the electrical contact.

A method according to the present invention manufactures an electrical contact by mixing powders of chromium, one of copper and silver, and the carbide to yield a powder mixture, subjecting the powder mixture to compact molding, and sintering the molded mixture. As the raw materials for the electrical contact according to the present invention, the powders of chromium and one of copper and silver preferably each have a average particle size of 75 μm or less, and the carbide powder preferably has a average particle size of 20 μm or less. This yields a desired structure that is excellent in moldability and is uniform, in which the carbide surrounds chromium particles. The sintering is preferably carried out at temperatures equal to or lower than the melting point of copper or silver in a vacuum, in an inert gas, or in hydrogen atmosphere. The carbide does not decompose at these temperatures. This enables near net shaping to a final shape, eliminates the need for postmachining, and yields an inexpensive electrical contact. The compact molding is preferably carried out at a forming pressure of 120 to 500 MPa. If the forming pressure is less than 120 MPa, the molded article is difficult to handle. If it exceeds 500 MPa, the material powders are susceptible to adhesion to the die, and this invites a shorter die lifetime and a reduced productivity.

An embodiment of the electrical contacts according to the present invention has a chopping current of 1 to 2.5 A and shows a maximum interrupting current "y" (kA) satisfying following Expression (1):

$$0.44x<y<1.32x \qquad \text{Expression (1)}$$

wherein "x" is the diameter (mm) of the contact. By satisfying this, the resulting vacuum circuit breaker does not require a surge absorber and can interrupt a large current. This condition can be satisfied by constructing an electrical contact comprising the above-mentioned components and having the above-mentioned structure, and the low surge voltage and the excellent interruption performance can be achieved concurrently.

An electrode using the electrical contact according to the present invention is in the form of a disc and comprises a central hole arranged at the circular center of the disc; and a plurality of through slit grooves being not in contact with the central hole and extending from the circular center to the circumference of the disc. The electrode has a plan shape divided into wings by the slit grooves. By satisfying this, arc is prevented from generating at the center of the electrode. In addition, the slit grooves give driving force to arc and prevent the arc from stopping to thereby prevent interruption failure.

An other electrode using the electrical contact according to the present invention comprises a discoidal member; and an electrode rod integrally fixed to a side of the discoidal member opposite to an arc generation side. The discoidal member comprises the electrical contact according to the present invention. The electrode having this configuration has the desired performances.

A vacuum interrupter according to the present invention comprises a vacuum chamber, and a pair of a fixed electrode and a movable electrode arranged in the vacuum chamber, in which at least one of the electrodes comprises the electrode using the electrical contact according to the present invention.

A vacuum circuit breaker according to the present invention comprises a vacuum interrupter, conductive terminals, and a operating device, the vacuum interrupter comprising a vacuum chamber and a pair of a fixed electrode and a movable electrode arranged in the vacuum chamber, the conductive terminals arranged outside the vacuum interrupter and being connected to each of the fixed electrode and the movable electrode in the vacuum interrupter, and the operating device acting to drive the movable electrode, in which at least one of the fixed electrode and the movable electrode uses the electrical contact according to the present invention. This yields vacuum circuit breakers and various vacuum switchgears that have excellent interruption performance and show a low surge voltage concurrently.

Embodiments of the present invention will be described in detail, which by no means limit the scope of the present invention.

Embodiment 1

An electrical contact comprising copper as a matrix, and chromium particles surrounded by Sic and dispersed in the matrix was prepared, and an electrode was prepared using the electrical contact. FIG. 1 is a view of the prepared electrode. The electrode in FIG. 1 comprises an electrical contact 1 having spiral grooves 2 for giving driving force to arc, thereby to prevent the arc from stopping, a reinforcement plate 3 made of stainless steel, an electrode rod 4, a solder material 5, and a central hole 51 constituting a concave portion for preventing arc from generating at the center of the electrode.

The electrical contact 1 was prepared in the following manner. Initially, chromium powder and copper powder each having a average particle size of 75 μm or less, and SiC powder having a average particle size of 2 to 3 μm were mixed in a twin-cylinder mixer to make compositions of the electrical contacts shown in Table 1 below. Next, the powder mixture was charged into a die having such a shape as to form the through spiral grooves 2 and central hole 51 and yield the desired shape of the electrical contact, and the charged mixture was subjected to compact molding under a hydraulic pressure of 400 MPa. The density of the resulting compacted molding was about 73%. This was sintered at 1050° C. in a vacuum for two hours to yield electrical contact 1. The relative density of the electrical contact 1 was about 96%.

The electrodes were manufactured in the following manner. The electrode rod 4 of oxygen-free copper and the reinforcement plate 3 of stainless steel SUS 304 were machined into a desired shape. The projection of the electrode rod 4 was inserted into the central hole 51 of the electrical contact 1 prepared by sintering and the central hole of the reinforcement plate 3, and they were assembled with a solder material 5. The solder material 5 was also placed between the electrical contact 1 and the reinforcement plate 3. The assemblies were heated at 970° C. in a vacuum of $8.2\times10^{-4}$ Pa or less for ten minutes to produce the electrode shown in FIG. 1. The electrodes were used for a vacuum interrupter of a rated voltage of 7.2 kV, a rated current of 600 A, and a rated interrupting current of 20 kA. If the strength of the electrical contact 1 is sufficient, the reinforcement plate 3 may be omitted.

The electrical contact 1 can also be prepared according to the above-mentioned method when the carbide is at least one of TiC, WC, $Cr_3C_2$, $Be_2C$, $B_4C$, ZrC, HfC, NbC, TaC, ThC, and VC instead of SiC, and when the matrix component is silver.

Embodiment 2

In the second embodiment, electrical contacts structurally having a copper matrix and SiC particles dispersed in the matrix were prepared, and electrodes were prepared using these electrical contacts. The structure of the electrodes is the same as in the first embodiment, as shown in FIG. 1.

The electrical contact 1 was prepared in the following manner. Initially, chromium powder, SiC powder and the balance being cu each having a average particle size of 75 μm or less were mixed in a twin-cylinder mixer to make compositions of the electrical contacts shown in Table 1 below. Next, the powder mixture was charged into a die having such a shape as to form the through spiral grooves 2 and central hole 51 and yield the desired shape of the electrical contact, and the charged mixture was subjected to compact molding under a hydraulic pressure of 400 MPa. The density of the resulting compacted molding was about 73%. This was sintered at 900° C. to 1050° C. in a vacuum for two hours to yield the electrical contact 1. The relative density of the resulting electrical contact 1 was about 94%.

The manufacturing method for the electrodes is the same as in the first embodiment. The electrode shown in FIG. 1 was prepared.

The electrodes were used for a vacuum interrupter of a rated voltage of 7.2 kV, a rated current of 600 A, and a rated interrupting current of 20 kA.

If the strength of the electrical contact 1 is sufficient, the reinforcement plate 3 may be omitted.

The electrical contact 1 can also be prepared according to the above-mentioned method when the carbide is one of TiC, WC, $Cr_3C_2$, $Be_2C$, $B_4C$, ZrC, HfC, NbC, TaC, ThC, and VC instead of Sic. These carbides can be used in combination.

As the carbide, SiC is especially preferred, and TiC and WC are preferred. These carbides are advantageous in that the deformation of surface as a result of heating by arc is small, although they may invite an increased chopping current of about 7 A.

Embodiment 3

Using the electrodes manufactured in the first and second embodiments, a vacuum interrupter provided with the electrode was manufactured. The specification of the vacuum interrupter were: a rated voltage of 7.2 kV, a rated current of 600 A, and a rated interrupting current of 20 kA.

Figure 2:
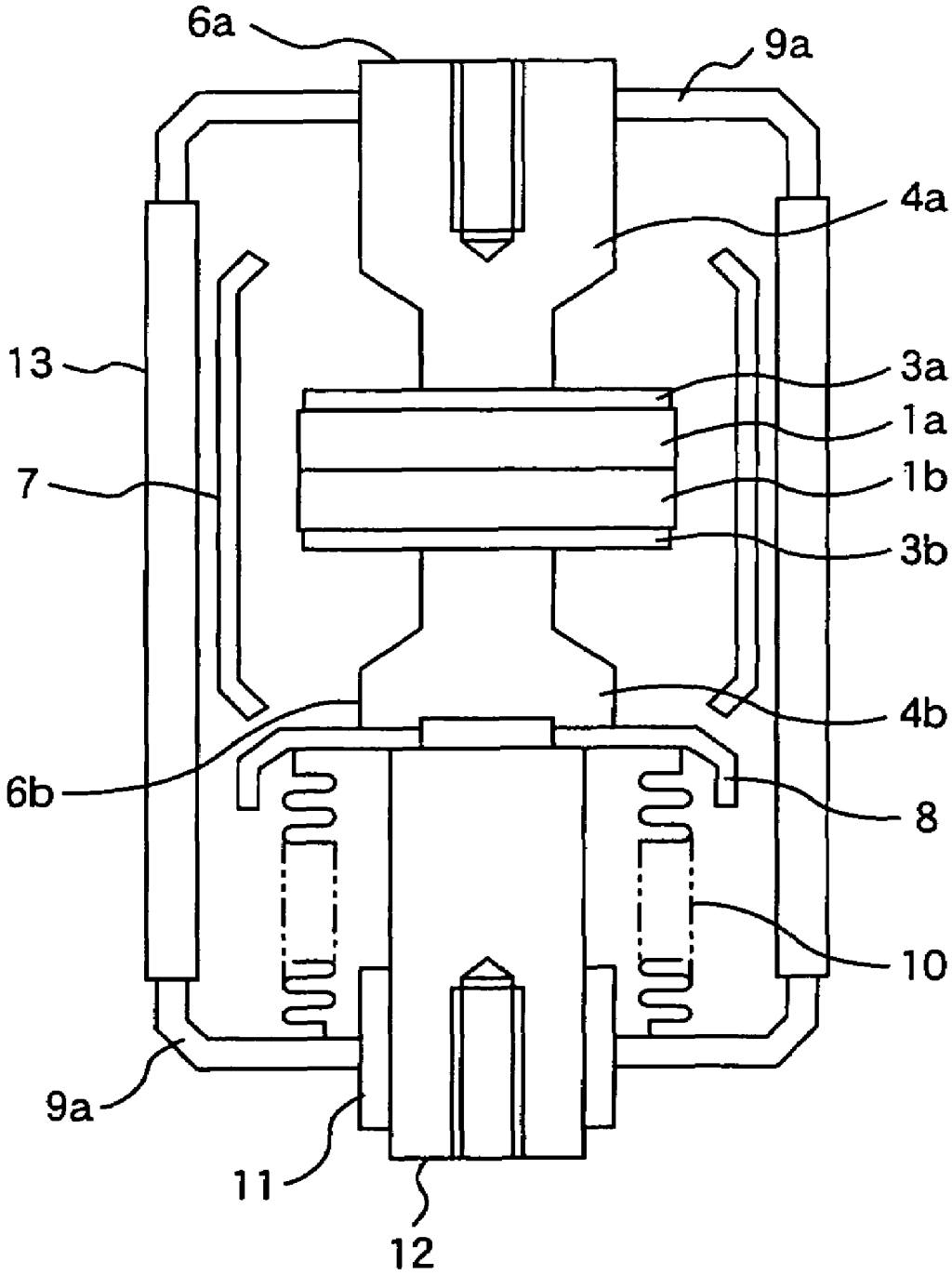
FIG. 2 is a diagram showing the structure of a vacuum interrupter according to the third embodiment of the present invention.

FIG. 2 is a view showing the structure of the vacuum interrupter according to the third embodiment. The vacuum interrupter in FIG. 2 comprises a fixed electrical contact 1*a*, a movable electrical contact 1*b*, reinforcement plates 3*a* and 3*b*, a fixed electrode rod 4*a* and a movable electrode rod 4*b*, so that the fixed electrode 6*a* and the movable electrode 6*b* are constituted.

The movable electrode 6*b* is bonded by soldering to a movable holder 12 through a movable shield 8 for preventing scattering of metal vapor upon current interruption. These members are highly vacuum-tightly sealed by soldering with a fixed end plate 9*a*, a movable end plate 9*b*, and an insulating cylinder 13. The screw portions of the fixed electrode 6*a* and movable holder 12 are connected to the exterior conductors, respectively.

There is disposed in the insulating cylinder 13 a shield 7 for preventing scattering metal vapor and a guide 11 for supporting a sliding portion disposed between the movable end plate 9*b* and the movable holder 12. A bellows 10 is disposed between the movable shield 8 and the movable end plate 9*b* thereby to let the movable holder 12 move up and down to turn on and off the fixed electrode 6*a* and the movable electrode 6*b*, while keeping the vacuum interrupter in vacuum.

Using the electrical contacts manufactured in the first and second embodiments as the electrical contacts 1*a* and 1*b* in FIG. 2, the vacuum interrupter according to the present invention was prepared.

Embodiment 4

A vacuum circuit breaker provided with the vacuum interrupter manufactured in the third embodiment was prepared.

Figure 3:
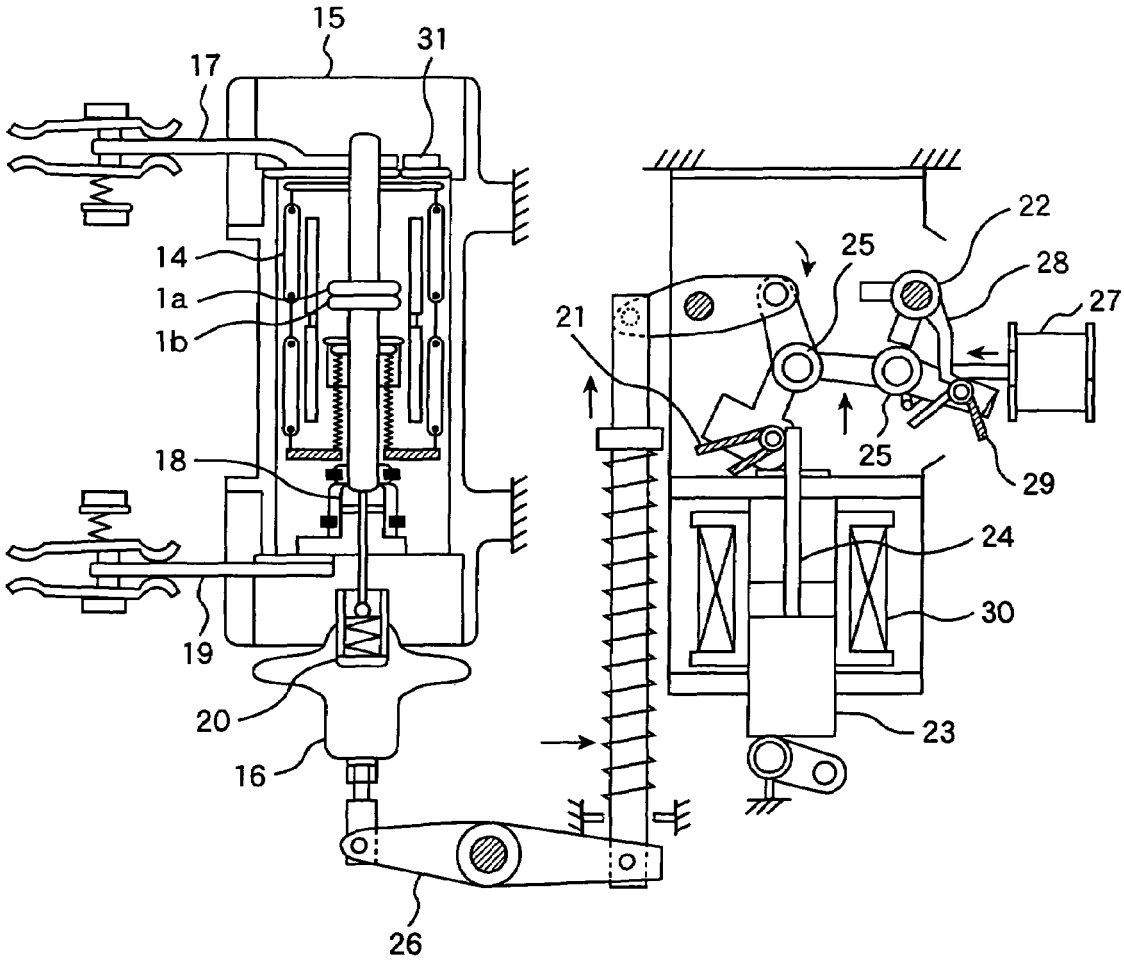
FIG. 3 is a diagram showing the structure of a vacuum circuit breaker according to the fourth embodiment of the present invention.

FIG. 3 is a schematic view of the circuit breaker comprising the vacuum interrupter 14 according to the fourth embodiment and an operating mechanism thereof.

The vacuum circuit breaker has the operating mechanism in the front side and three epoxy resin cylinders 15 in the backside. The epoxy resin cylinders 15 supports the three vacuum interrupters for three phases, respectively. The vacuum interrupter 14 is connected to and turned on and off by the operating mechanism through an insulating operating rod 16.

When the circuit breaker is in a closed position, current flows an upper terminal 17, the electrical contact 1, a collector 18, and a lower terminal 19. A contact force between the electrodes is kept by a contact spring 20 disposed to the insulating operating rod 16. The contact force between the electrodes and the electromagneto-motive force caused by short-circuit current is maintained by a supporting lever 21 and a plop 22. When a closing coil 30 is excited, the electrodes in an open state are closed by a plunger 23 that pushes a roller 25 upward by means of a knocking rod 24 to rotate a main lever 26, then the roller 25 is supported by the supporting lever 21.

In a free state that the circuit breaker is in a tripped condition, a tripping coil 27 is excited so that a tripping lever 28 disconnects the plop 22 to rotate the main lever 26 thereby to separate the electrodes.

In a state that the circuit breaker is in an open state, the link returns to the original position by a reset spring 29 and, at the same time, the plop 22 engages, after the electrodes are separated. In this state, the closing coil 30 is excited to close the electrodes. The numeral 31 denotes an evacuation tube.

Embodiment 5

The electrical contact manufactured in the first embodiment was used to prepare the vacuum interrupter of the rated voltage of 7.2 kv, rated current of 600 A and rated interrupting current of 20 kA shown in the third embodiment, and the vacuum interrupter was installed to the vacuum circuit breaker of the fourth embodiment, which was subjected to breaking performance tests. Table 1 shows the compositions of the electrical contacts, electrode diameters, and results in the breaking performance tests. The samples Nos. 1 to 8 are Examples according to the present invention, and the samples Nos. 9 to 11 are Comparative Examples.

TABLE 1

| | | Diameter of electrode | Composition of electrical contact | | | Results in breaking performance test | | |
|---|---|---|---|---|---|---|---|---|
| Category | No. | (mm) | Cr (weight %) | SiC (weight %) | Cu | Chopping current (A) | Maximum interrupting current (kA) | State of SiC |
| Example | 1 | 34 | 35 | 0.5 | balance | 2.3 | 19 | Cohere cohered |
| | 2 | 34 | 35 | 5 | balance | 1.5 | 28 | around chromium |
| | 3 | 34 | 35 | 10 | balance | 1.4 | 31 | |
| | 4 | 34 | 35 | 15 | balance | 1.2 | 24 | |
| | 5 | 34 | 5 | 5 | balance | 1.5 | 17 | |
| | 6 | 34 | 40 | 5 | balance | 1.7 | 20 | |
| | 7 | 26 | 35 | 5 | balance | 1.5 | 22 | |
| | 8 | 38 | 35 | 5 | balance | 1.6 | 33 | |
| Comp. Ex. | 9 | 34 | 35 | 5 | balance | 2.9 | 25 | homogenously dispersed in Cu |
| | 10 | 34 | 35 | 0 | balance | 3.4 | 16 | Cohere cohered |
| | 11 | 34 | 35 | 20 | balance | 1.2 | 14 | around chromium |

Figure 4:
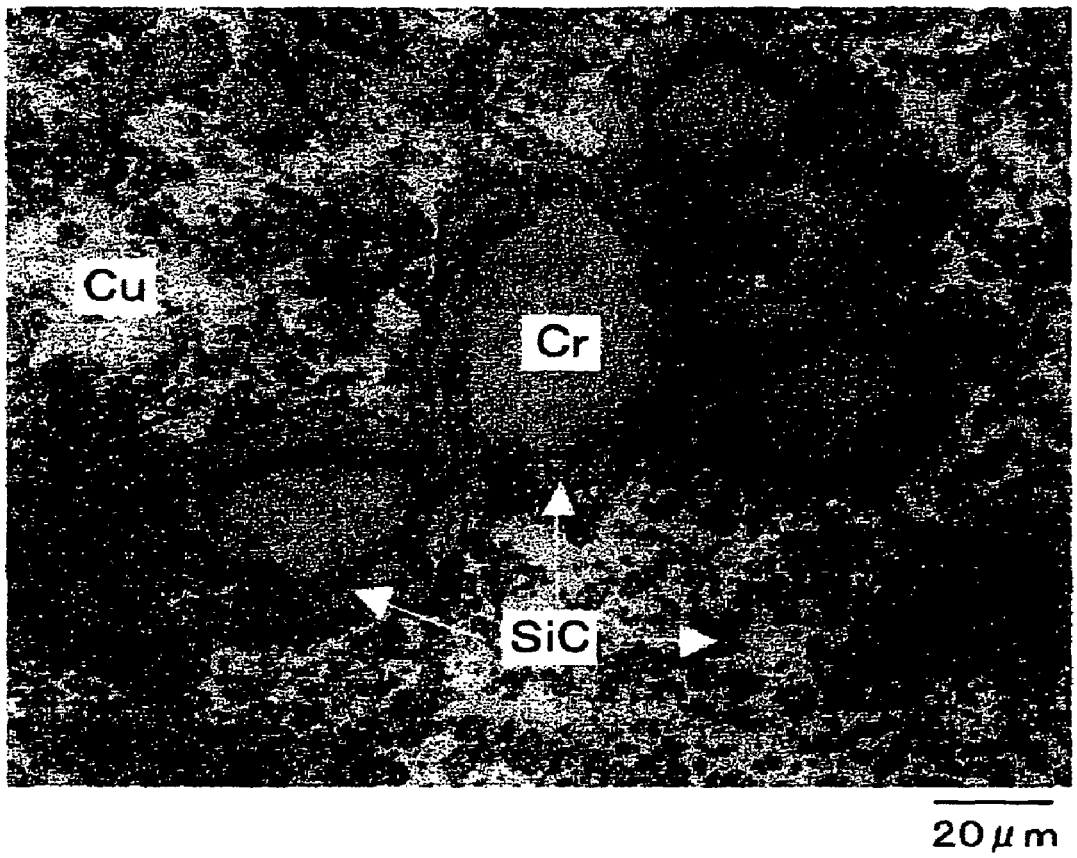
FIG. 4 is a diagram showing the structure of an electrical contact according to the fifth embodiment of the present invention.

Examples Nos. 1 to 8 and Comparative Examples Nos. 10 and 11 have a structure in which SiC is cohered so as to surround chromium particles. FIG. 4 is a photograph of the structure of Example No. 2 as an example of them.

The chopping current tends to decrease with an increasing SiC content within the SiC content of 0.5 to 15 percent by weight (No. 1 to No. 4). The maximum interrupting current (interruption performance) increases by comprising SiC. However, with an excessively large amount of SiC (No. 4), the interruption performance tends to decrease, because the contact density decreases.

In contrast, the chopping current is relatively large and the maximum interrupting current is small when SiC is not contained (No. 10). When the SiC content exceeds 15 percent by weight (No. 11), the contact density markedly decreases and the maximum interrupting current significantly decreases.

The variation in chopping current is small with a varying chromium content (No. 5 and No. 6). However, the maximum interrupting current tends to increase with an increasing chromium content, because of improved voltage endurance properties.

The chopping current does not substantially vary but the maximum interrupting current increases with an increasing electrode diameter (No. 7 and No. 8).

Comparative Example No. 9 has a structure in which SiC is uniformly dispersed in Cu matrix and is not cohereed around chromium particles. Comparative Example No. 9 has a larger chopping current and a smaller maximum interrupting current than Example No. 2, even through they are the same in the contact composition. This indicates that the cohesion of SiC so as to surround chromium particles is effective to achieve a low surge voltage and to improve the interruption performance.

These results show that the electrical contacts according to the present invention enables excellent electrode performances including both excellent interruption performance and low surge voltage.

The same results can be obtained when the carbide is at least one of TiC, WC, $Cr_3C_2$, $Be_2C$, $B_4C$, ZrC, HfC, NbC, TaC, ThC, and VC instead of SiC, and when the matrix component is silver.

Embodiment 6

The electrical contacts manufactured in the second embodiment were used to prepare the vacuum interrupters of the rated voltage of 7.2 kV, rated current of 600 A and rated interrupting current of 20 kA shown in the third embodiment, and the vacuum interrupters were installed to the vacuum circuit breakers of the fourth embodiment, which were subjected to breaking performance tests.

Table 2 shows the compositions of the electrical contacts, diameters of the electrodes, and results in the breaking performance tests. The samples Nos. 1 to 5 are Examples according to the present invention, and the samples Nos. 6 to 9 are Comparative Examples.

current, does not effectively provide low-surge performance, and shows a low maximum interrupting current.

The sample having a SiC content exceeding 30 percent by weight (No. 7) shows poor sinterability to thereby decrease the density of the electrical contact material and thereby has a decreased maximum interrupting current, although it shows effective low-surge performance.

The samples having a weight ratio of chromium to SiC within the range of 1:1.5 to 1:50 (No. 4 and No. 5) have a small chopping current and do not deteriorate in chopping current after interruption of a current at 1 kA hundred times.

In contrast, the sample No. 8 has a relatively large Sic content with respect to the chromium content and a weight ratio of chromium to SiC of 1:1 (No. 8). This sample significantly deteriorate in chopping current after 100-times current interruption, although it has a small initial chopping current. This is because the sublimated Sic reacts with chromium as a result of heating by arc generated upon current interruption, and the content of SiC that acts to reduce the chopping current decreases.

The sample containing no SiC that acts to reduce the chopping current (No. 9) has a large chopping current as in the sample No. 6 and does not effectively provide low-surge performance, although it has a large maximum interrupting current.

Table 2 demonstrates that the chopping current is preferably 5 A or less; that the different between the initial chopping current and the chopping current after 100-times current interruption is preferably 1.5 A or less and more preferably 1.3 A or less; and that the maximum interrupting current is preferably 25 kA or more, and more preferably around 28 kA.

These results show that the electrical contacts described herein can yield excellent electrode performances including interruption performance and low-surge performance and are capable of maintaining the action of reducing the chopping current. Substantially the same advantages may be obtained

TABLE 2

| | | Composition of electrical contact | | | Results in breaking performance test | | | |
|---|---|---|---|---|---|---|---|---|
| | | | | | Maximum chopping current (A) upon interruption of current of 1 kA | | Maximum | |
| Category | No. | Cr (weight %) | SiC (weight %) | Cu | Initial | After 100-times interruption | interrupting current (kA) | Remarks |
| Example | 1 | — | 1 | balance | 4.5 | 3.2 | 28 | |
| | 2 | — | 10 | balance | 1.7 | 1.8 | 28 | |
| | 3 | — | 30 | balance | 1.9 | 2.0 | 28 | |
| | 4 | 6.7 | 10 | balance | 2.3 | 2.3 | 28 | Cr:SiC = 1:1.5 |
| | 5 | 0.2 | 10 | balance | 1.7 | 2.0 | 28 | Cr:SiC = 1:50 |
| Comp. Ex. | 6 | — | 0.5 | balance | 6.0 | 4.8 | 27 | SiC: less than 1% by weight |
| | 7 | — | 35 | balance | 2.1 | 2.2 | 20 | SiC: more than 30% by weight |
| | 8 | 10 | 10 | balance | 3.2 | 6.1 | 29 | Cr:SiC = 1:1 |
| | 9 | 10 | — | balance | 6.7 | 6.4 | 29 | no SiC |

The samples having a Sic content within the range of 1 to 30 percent by weight (No. 1 to No. 3) show a relatively low chopping current due to the sublimation of Sic. They do not show significantly increased chopping current and can maintain low-surge property even after interrupting a current of 1 kA hundred times.

In contrast, the sample having a SiC content less than 1 percent by weight (No. 6) has a relatively large chopping when the carbide is one selected from TiC, WC, $Cr_3C_2$, $Be_2C$, $B_4C$, ZrC, HfC, NbC, TaC, ThC, and VC instead of SiC.

Embodiment 7

In the seventh embodiment, the vacuum interrupter prepared according to the third embodiment was mounted to a vacuum switchgear other than the vacuum circuit breaker.

Figure 5:
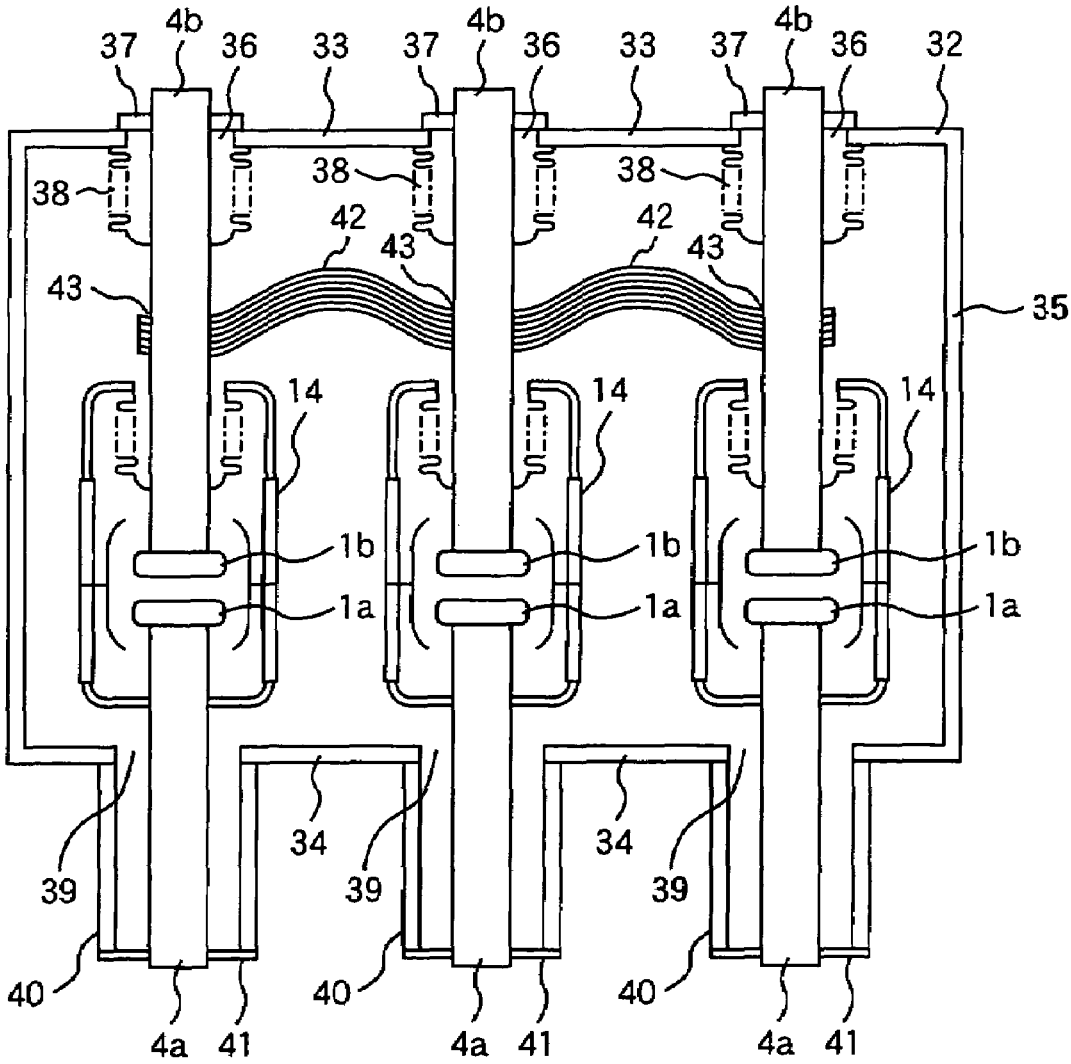
FIG. 5 is a diagram showing the structure of a load breaking switchgear for a pad-mount transformer according to the seventh embodiment of the present invention.

FIG. 5 shows a load breaking switchgear for a pad-mount transformer having a vacuum interrupter 14 prepared in the third embodiment.

The load breaking switchgear is provided with plural pairs of vacuum interrupters 14 corresponding to the main circuit switch section in a vacuum-sealed exterior vacuum chamber 32. The exterior vacuum chamber 32 comprises an upper plate member 33, a lower plate member 34 and side plate members 35. The peripheries of the plate members are welded. The exterior vacuum chamber 32 is installed together with a main body of the switchgear.

The upper plate member 33 has upper through-holes 36, the peripheries of which have ring-shaped insulating upper bases 37 to seal the through-holes 36. Columnar movable electrode rods 4*b* are reciprocately (up-and-down movement) inserted into the circular spaces formed in the central parts of the upper bases 37. That is, the upper through-holes 36 are vacuum-tightly sealed by the upper bases 37 and the movable electrode rods 4*b*.

The axial ends (upper sides) of the movable electrode rods 4*b* are connected to operators (electro-magnetic operators) disposed at the exterior of the exterior vacuum chamber 32. The upper plate member 33 has outer bellows 38, which are reciprocately (up-and down movement) fixed to the peripheries of the upper through-holes 36. Each of the outer bellows 38 is fixed to the lower side of the upper plate member 33 at its axial end, and is fixed to the circumferential face of each of the movable electrode rods 4*b* at its other end. That is, in order to vacuum-tightly seal the exterior vacuum chamber 32, the outer bellows 3B are disposed at the peripheries of the upper through-holes 36 and along the axes of the movable electrode rods 4*b*. The upper plate member 33 is connected to an evacuation tube (not shown) through which the exterior vacuum chamber 32 is evacuated.

The lower plate member 34 is provided with lower through-holes 39; insulating bushings 40 are fixed to the peripheries of the lower through-holes 39 thereby to cover the lower through-holes. Ring-shaped lower bases 41 are disposed to the bottom parts of the insulating bushings 40. Columnar fixed electrode rods 4*a* are inserted into the central circular spaces of the lower bases 41. That is, the lower through-holes 39 formed in the lower plate member 34 are vacuum-tightly sealed by the insulating bushings 40, the lower bases 41 and fixed electrode rods 4*a*. Each of the fixed electrode rods 4*a* is connected at one end (lower side) in the axial direction to each of cables (transmission cables) disposed outside of the exterior vacuum container 32.

The vacuum interrupters 14 corresponding to the main circuit switch of the load-breaking switch are housed in the exterior vacuum container 32. Each of the movable electrode rods 4*b* are connected to each other through flexible conductors 42 having two curved portions. The flexible conductors 42 are prepared by laminating copper plates and stainless steel plates alternately, the copper plates and the stainless steel plates having two curved portions in the axial direction of the electrode rods 4*a*, 4*b*. The flexible conductors 42 have through-holes 43, into which the movable electrode rods 4*b* are inserted.

As having been discussed, the vacuum interrupters according to the second embodiment can be applied to the load breaking switchgear for the pad-mount switchgear. Further, the vacuum interrupter according to the present invention can be employed for other vacuum switchgears such as vacuum insulated switchgears.

What is claimed is:

1. An electrical contact made of an alloy comprising chromium particles; one of copper and silver phase; and silicon carbide particles, wherein the electrical contact comprises a matrix phase and a chromium phase, the matrix phase mainly comprising the one of copper and silver phase, and the chromium phase being surrounded by the silicon carbide particles and dispersed in the matrix phase, and wherein the copper has a lead content of 0.2 to 1 percent by weight.

2. The electrical contact according to claim 1, wherein the alloy comprises 1 to 30 percent by weight of the carbide with the balance being copper.

3. The electrical contact according to claim 1, wherein the alloy comprises chromium, copper, and the carbide, wherein the weight ratio of chromium to the carbide is within the range of 1:1.5 to 1:50.

4. The electrical contact according to claim 3, wherein an amount of the carbide is 1 to 30 percent by weight.

5. An electrical contact according to claim 1, wherein the alloy comprises chromium, copper, and the carbide, wherein the electrical contact has a chromium content of 0.02 to 20 percent by weight and the carbide has a content of 1 to 30 percent by weight, with the balance being copper, and wherein the carbide content is higher than the chromium content.

6. The electrical contact according to claim 1, wherein the carbide is capable of sublimating by the action of arc.

7. The electrical contact according to claim 1, wherein the carbide has a sublimation point or decomposition point of 1800° C. or higher.

8. An electrical contact according to claim 1, wherein the electrical contact has a chopping current of 1 to 2.5 A and shows a maximum interrupting current "y" (kA) satisfying following Expression (1):

$$0.44x<y<1.32x \qquad \text{Expression (1)}$$

wherein "x" is the diameter (mm) of the contact.

9. An electrode comprising the electrical contact of claim 1 and an electrode rod to which the contact is bonded, the contact being in the form of a disc and having a central hole arranged at the circular center of the disc and a plurality of through slit grooves being not in contact with the central hole and extending from the circular center to the circumference of the disc.

10. An electrode comprising a discoidal member and an electrode rod integrally fixed to a side of the discoidal member opposite to an arc generation side, wherein the discoidal member is the electrical contact of claim 1.

11. A vacuum interrupter comprising a vacuum chamber; and a pair of a fixed electrode and a movable electrode arranged in the vacuum chamber, wherein at least one of the fixed electrode and the movable electrode is the electrode of claim 9.

12. A vacuum circuit breaker comprising a vacuum interrupter, conductive terminals, and a operating device, the vacuum interrupter comprising a vacuum chamber, and a pair of a fixed electrode and a movable electrode arranged in the vacuum chamber, the conductive terminals being connected to each of the fixed electrode and the movable electrode in the vacuum interrupter, and the operating device serving to drive the movable electrode, wherein the vacuum interrupter is the vacuum interrupter of claim 11.

13. An electrical contact made of an alloy comprising chromium particles; one of copper and silver phase; and silicon carbide particles, wherein the electrical contact comprises a matrix phase and a chromium phase, the matrix phase mainly comprising the one of copper and silver phase, and the chromium phase being surrounded by the silicon carbide particles and dispersed in the matrix phase, wherein the chromium particles have a particle size of 75 μm or less and the silicon carbide particles have a particle size of 2 to 3 μm.

14. The electrical contact according to claim 1, wherein the silicon carbide particles are cohered or concentrated at the boundary between the copper or silver phase and the chromium particles.

15. The electrical contact according to claim 1, wherein a content of the silicon carbide particles is larger than that of the chromium particles.

16. The electrical contact according to claim 1, wherein the silicon carbide sublimates upon current interruption to reduce a chopping current.

17. An electrical contact comprising an alloy, which is constituted by copper or silver matrix phase, silicon carbide particles dispersed in the copper or silver phase and chromium particles surrounded with a carbide wherein the copper has a lead content of 0.2 to 1 percent by weight.

* * * * *